US005542572A

United States Patent [19]

Davis

[11] Patent Number: 5,542,572

[45] Date of Patent: Aug. 6, 1996

[54] BEVERAGE DISPENSER REMOVABLE DRIPTRAY

[75] Inventor: Harlan R. Davis, Mason City, Iowa

[73] Assignee: IMI Cornelius Inc., Anoka, Minn.

[21] Appl. No.: 401,056

[22] Filed: Mar. 8, 1995

[51] Int. Cl.[6] ..... B67D 1/16

[52] U.S. Cl. ..... 222/108; 222/129.1; 141/86

[58] Field of Search ..... 222/108, 129.1–129.4; 141/86; 137/312, 313; 312/229

[56] References Cited

U.S. PATENT DOCUMENTS 3,327,902 6/1967 Alterwitz ..... 222/129.1 X
4,782,667 11/1988 Kito et al. ..... 222/108 X
4,865,225 9/1989 Chavez et al. ..... 222/108
5,063,977 11/1991 Belland ..... 141/86

*Primary Examiner*—Gregory L. Huson
*Attorney, Agent, or Firm*—Sten Erik Hakanson

[57] ABSTRACT

A beverage dispenser having a quickly removable drain tray. The drain tray having a perimeter edge depending to a bottom surface. The bottom surface angled in a direction towards a drain thereof. The drain having a short extended portion for cooperative insertion into a drain tube. The drain tube secured to the beverage dispenser, and the beverage dispenser including a drain tray receiving portion and a drain tray clearance area. The drain tray easily removed from or placed into the beverage dispenser by vertical translation for removing or inserting the extended portion within the drain tube.

10 Claims, 4 Drawing Sheets

BEVERAGE DISPENSER REMOVABLE DRIPTRAY

BACKGROUND OF THE INVENTION

1. Field of the Invention

The present invention relates generally to drip trays for use in beverage dispensing equipment, and in particular, to drip trays that can be easily installed and removed.

2. Description of the Related Art

Fountain beverage dispensing equipment is well known in the art and generally consists of one or more beverage dispensing valves supported on an upright member, below which is positioned a drip tray for catching any spilled or excess beverage. The drip tray generally consists of a vacuum formed piece of plastic having a perimeter edge and an inclined bottom surface designed to direct liquid to one or more drain hole outlets. The perimeter edge will usually includes a lip for supporting a wire cup rest. Each drain hole also typically include a hose fitting extending therethrough and secured thereto. The hose then extends generally vertically down through the housing of the dispenser for directing the waste liquid to a suitable drain.

It is a common experience for the drains of fountain beverage drip trays to become clogged over time. Often, successful unplugging of the drain requires access to the fitting for removal of the hose clamp and the hose. Unfortunately, the hose fitting and clamp are generally located within a sheet metal housing of the dispenser at a position that is generally difficult to access. The problem of access can be further exacerbated by the fact that beverage dispensers can be installed in a customized manner and "built in" to a customer's countertop. Accordingly, it would be highly desirable to have a drip tray that can be quickly and easily serviced and cleaned.

SUMMARY OF THE INVENTION

The drain tray of the present invention includes a top perimeter edge and perimeter side walls depending downward therefrom to a bottom surface. The bottom surface is inclined to direct liquids flowing thereon towards a drain. The drain includes a tubular section extending from and integral with the drain hole. The sidewalls and perimeter edge serve to define a narrow perimeter shelf for supporting a cup support tray thereon.

In one embodiment, the drain tray of the present invention is used in a drop-in type ice cooled beverage dispenser. Such a dispenser includes a lower ice retaining bin to which a beverage tower is secured along a top rear edge thereof. A rigid drain tube is secured within the lower bin and extends vertically along the same side thereof to which the tower is secured. The drain tube terminates on one end just above the top surface of the lower bin and within the tower, and terminates with a fitting on an opposite end at a suitable lower level just exterior of the lower housing.

The tower and the ice retaining bin define a horizontal tray receiving housing. When retained within the tray receiving housing, the tray drain tubular section extends into the top end of the drain tube by a simple insertion therein. The tower and the drain tray housing are designed to provide clearance for the drain tubular section sufficient to permit enough horizontal movement of the drain tray so that the tubular extension clears the drain tube. In this manner, the drain tray can then be translated essentially horizontally to provide for removal from or the insertion thereof into the tray receiving housing.

BRIEF DESCRIPTION OF THE DRAWINGS

A more thorough understanding of the structure operation and advantages of the present invention can be had by referring to the following detailed description, which refers to the following figures, wherein.

DETAILED DESCRIPTION OF THE PREFERRED EMBODIMENTS

Figure 3:
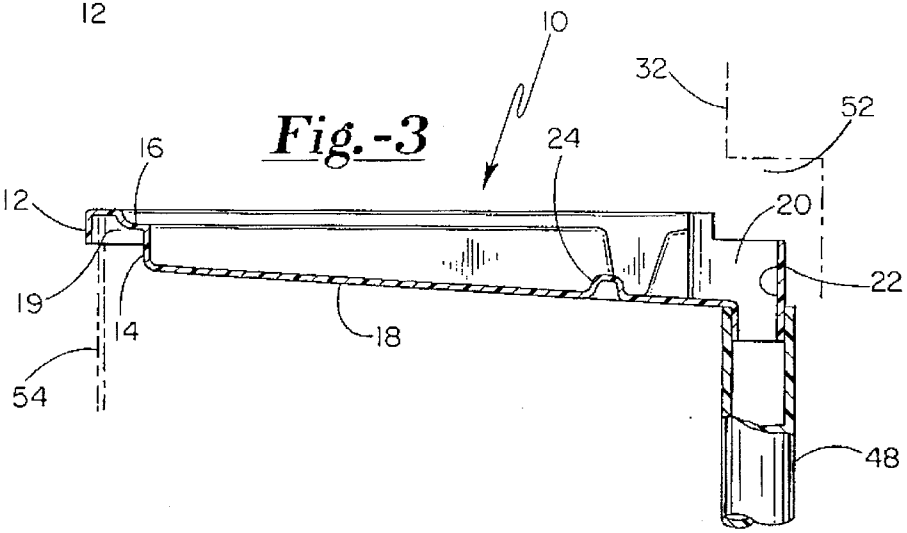
FIG. 3 shows a cross-sectional view along lines 3—3 of FIG. 2.
Figure 4:
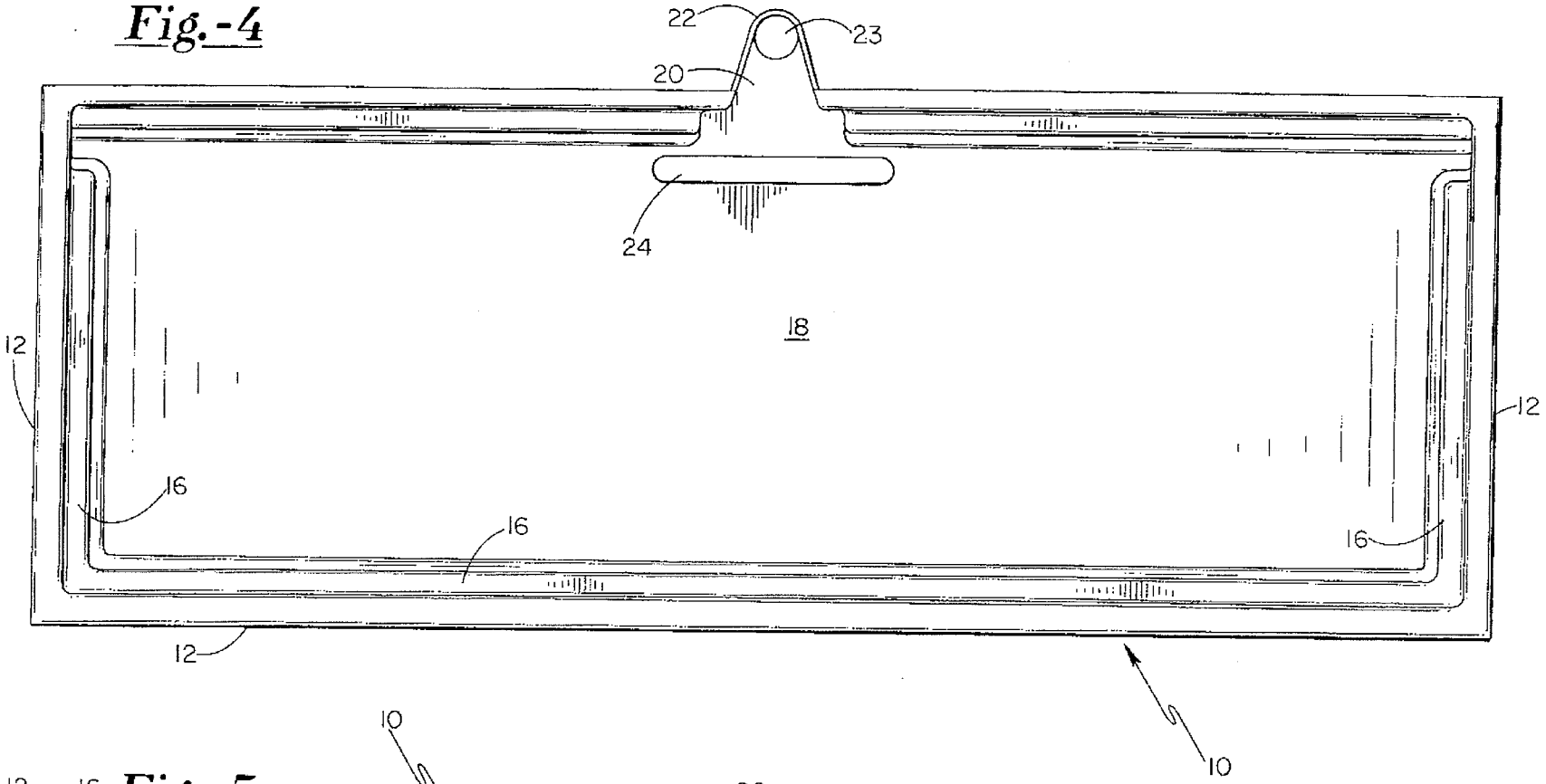
FIG. 4 shows a top plan view of the drain tray of the present invention.
Figure 5:
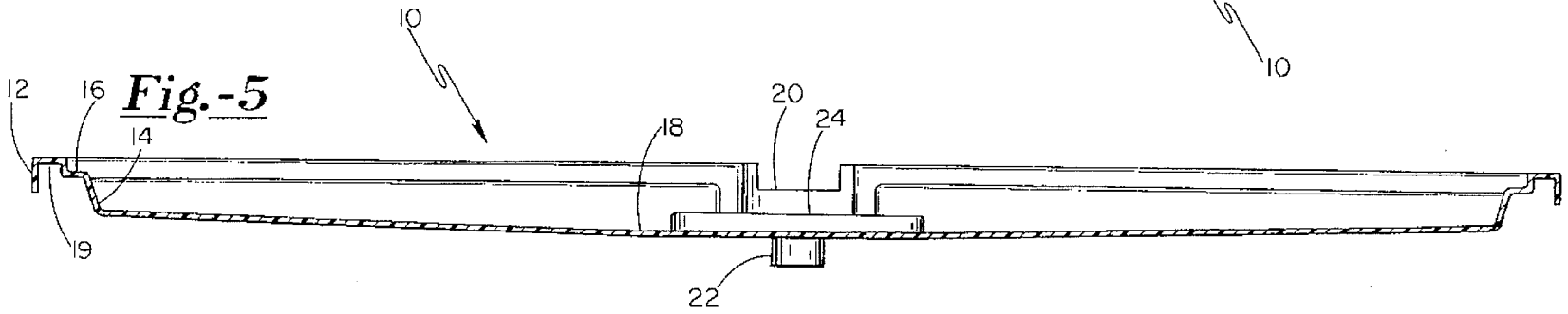
FIG. 5 shows a cross-sectional view along lines 5—5 of FIG. 4.

The tray of the present invention as seen in the various figures and generally referred to by the number 10. Tray 10 consists of vacuum formed plastic and is generally rectangular, including a top perimeter edge 12, perimeter side walls 14 and perimeter tray supporting shoulders 16. Side walls 14 depend to a bottom surface 18. As seen in FIG. 3, sidewalls 14, shoulders 16 and perimeter edge 12 define a perimeter cavity 19. Bottom surface 18 is generally inclined in a direction towards a drain area 20. Drain area 20 includes a short drain tube extension 22 integrally molded therewith and defining a drain hole 23. A blocking dam 24 is integrally molded into bottom surface adjacent drain area 20.

Figure 1:
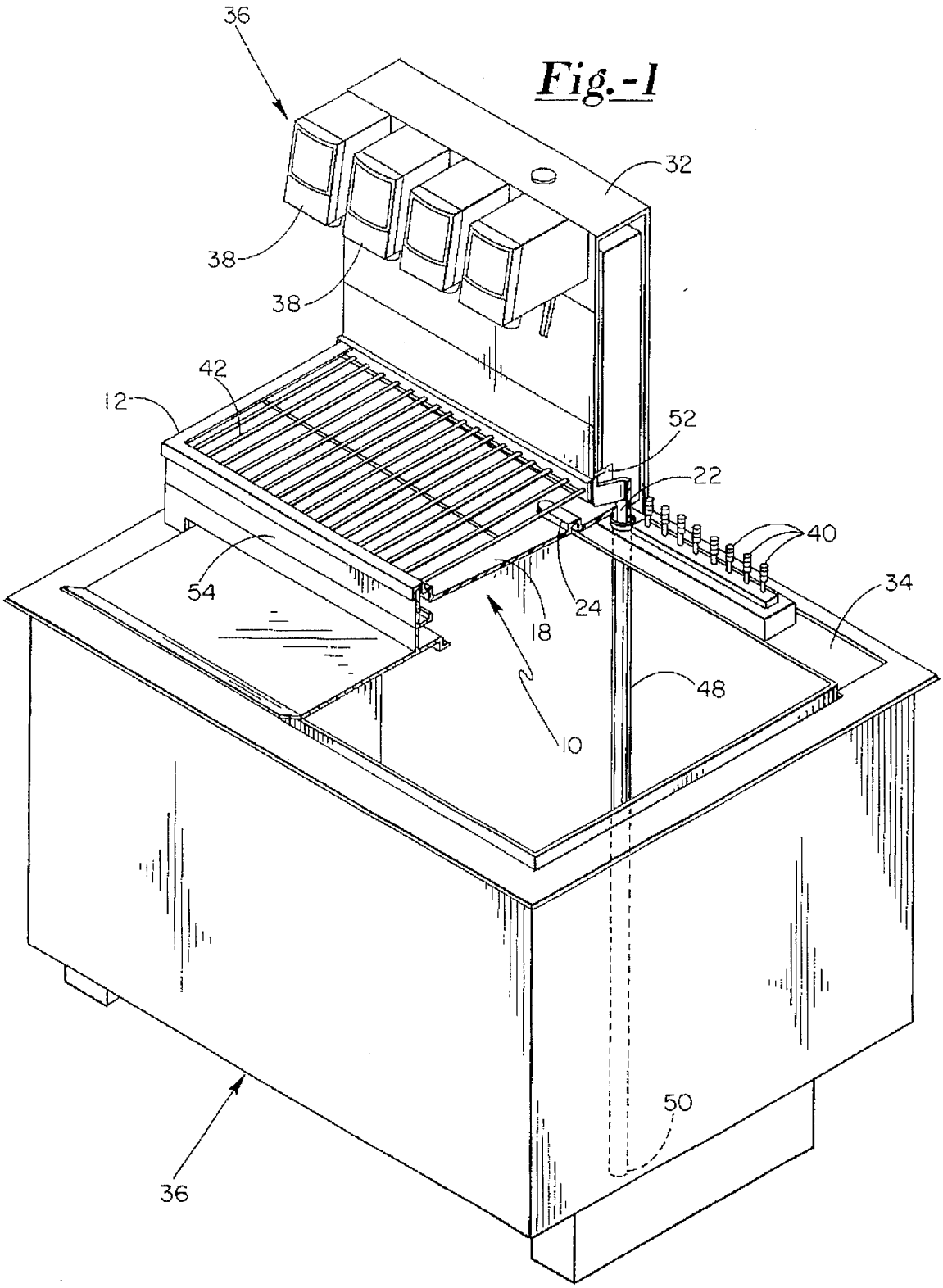
FIG. 1 is a partial cross-sectional perspective view of the present invention.
Figure 2:
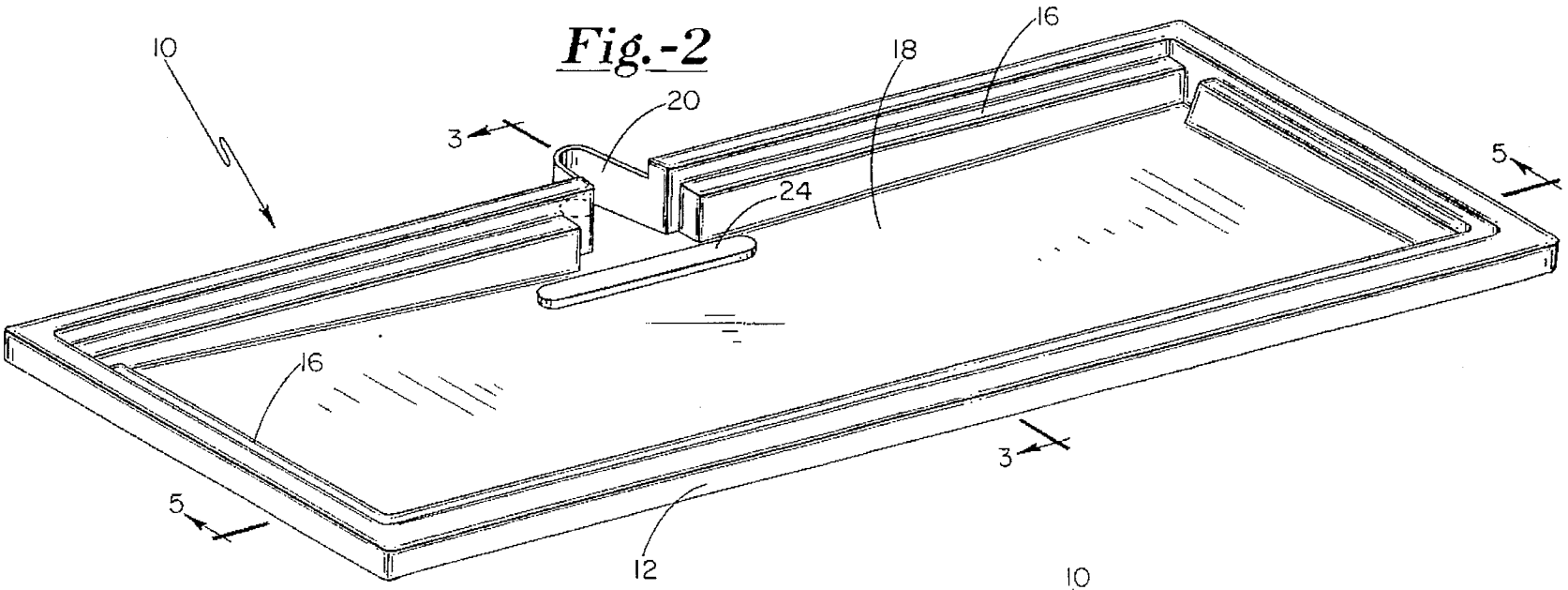
FIG. 2 shows a perspective view of the drain tray of the present invention.

As seen in FIG. 1, drain 10 is shown in position in a drop-in type beverage dispenser, generally referred to by the numeral 30. Dispenser 30 includes a tower 32 secured to a top back edge 34 of a ice retaining bin housing 36. Tower 32 includes a plurality of beverage dispense valves 38 secured thereto and includes a plurality of fluid delivery lines 40 for providing beverage to valves 38. A wire cup rest grate 42 is sized for resting on shoulders 16. As is known in the art, cups are placed on rest 42 underneath valves 38 for receiving of beverage therein. Dispenser 30 also includes a rigid drain tube 48 retained within the housing thereof and extending vertically along a back surface thereof. Tube 48 extends on one end slightly above the top surface of edge 34 and within beverage tower 32. The opposite end of tube 48 includes a fitting 50 for securing a flexible hose thereto or for hard plumbing of further drain tubes thereto. As can be seen more clearly by referring to FIG. 3, tower 32 includes a relieved area 52. In addition, housing 36 of dispenser 30 includes a tray support wall 54.

Tray 10 is installed into dispenser 30 by first a horizontal translation thereof whereby extension 22 is positioned above tube 48. Tray 10 is then lowered so that extension 22 is inserted into tube 48, and so that tray 10 rests on support wall 54 wherein a top edge of wall 54 is received in area cavity 19. Naturally, tray 10 is removed by the reverse of this procedure. It can be appreciated that the clearance provided by area 52 must be sufficient to permit the vertical translation of tray 10 to permit clearance of tube 48 by the extension 22 so that extension 22 can be inserted and removed therefrom.

Thus, it can be appreciated, that tray 10 can be simply lifted and removed or placed into dispenser 30 without the necessity of disconnecting any fittings or hoses. It will also be appreciated by those of skill that tube 48 and extension 22 can be made of sufficient diameters to provide for a snug insertion fitting there between.

Figure 6:
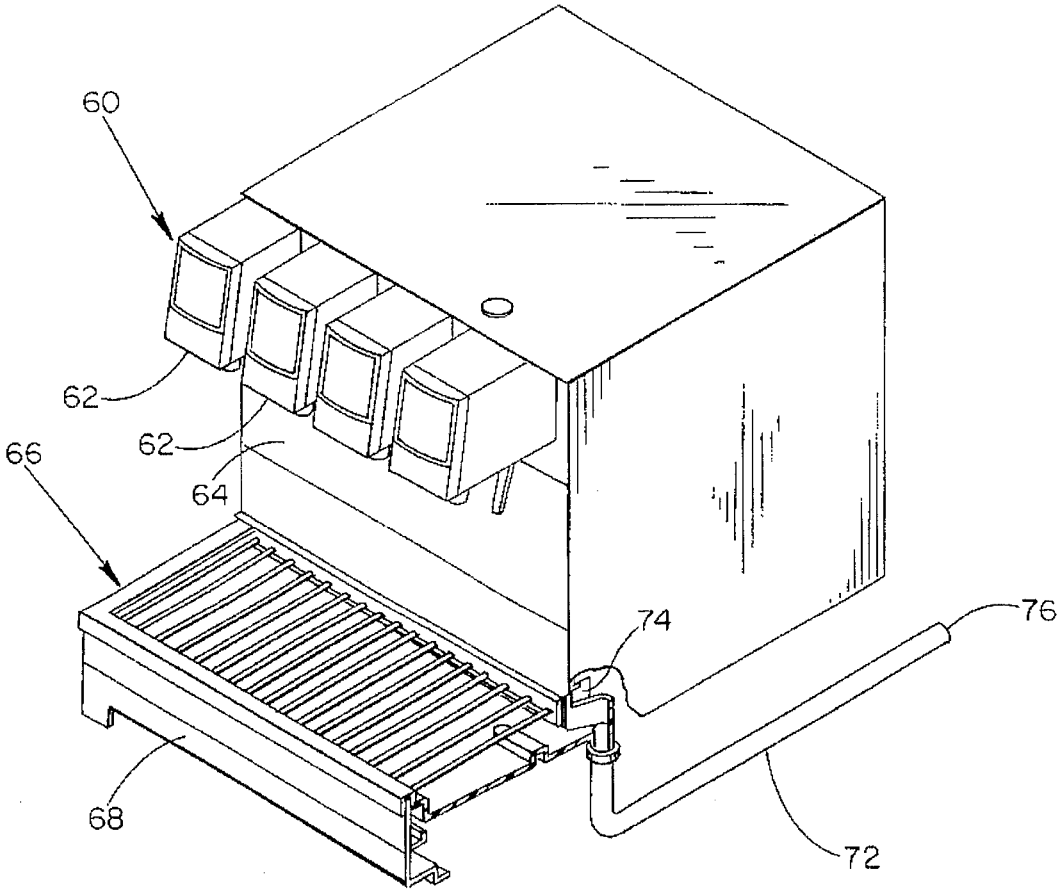
FIG. 6 shows a partial cross-sectional perspective view of an alternate embodiment of the present invention.
Figure 7:
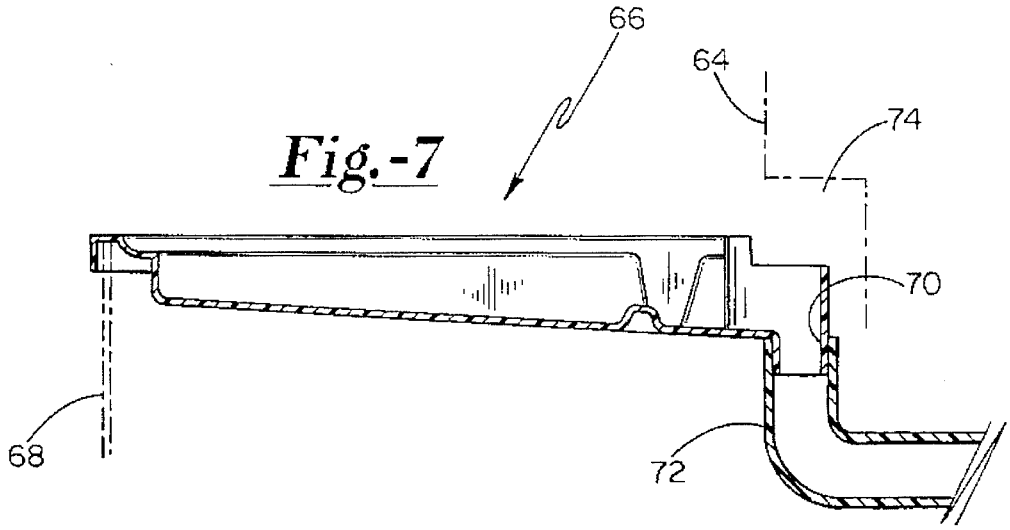
FIG. 7 shows a cross-sectional view along lines 7—7 of FIG. 6.

It will be appreciated by those with skill in the beverage dispensing arts that tray 10 can be used with various types of beverage dispensers, such as electrically cooled over counter units. As seen by referring to FIGS. 6 and 7, an over counter dispenser 60 is shown. Dispenser 60 includes valves 62 secured to a front housing surface 64. A tray 66, as with tray 10, rests on a tray support wall 68, and includes a drain extension 70. A rigid drain tube 72 is L-shaped and is secured underneath dispenser 60. Dispenser 60 includes a relieved area 74 for permitting vertical movement sufficient to permit insertion into tube 72 and removal therefrom of extension 70. It will be appreciated that tube 72 is L-shaped to permit the flow of drain liquids first along and underneath dispenser 60. Tube 72 includes a fitting 76 for securing of a drain hose or hard plumbed drain tubing thereto. Thus, tray 66 operates in the same manner as tray 10 whereby tray 66 is easily placed into and removed from dispenser 60 without the need for the disconnecting of any fittings or clamps.

I claim:

1. A beverage dispenser, comprising:

a drain tray having a bottom surface inclined towards a drain hole in the drain tray and having a drain hole extension extending generally vertically and downward from the hole, a lower housing portion having a drain tray receiving portion in which the drain tray can be placed and generally retained, a rigid drain tube secured to the lower housing portion, the drain tube having a first end sized to slidingly receive the drain hole extension therein and positioned to so receive the drain hole extension when the drain tray is retained in the drain tray receiving portion so that the drain tray can be removed from the drain tray receiving portion and the drain hole extension removed from the drain tube first end by generally vertical upward lifting of the drain tray and so that the drain tray can be placed into the drain tray receiving portion and the drain hole extension inserted into the drain tube first end by generally vertical downward movement of the drain tray.

2. The dispenser as defined in claim 1, and the drain tray having a perimeter edge defining a groove, and the drain tray receiving portion having a generally vertically extending support wall for cooperative insertion into the drain tray perimeter edge groove when the drain tray is held in the drain tray receiving portion for providing securing therebetween.

3. A beverage dispenser, comprising:

a drain tray having a bottom surface inclined towards a drain hole in the drain tray and having a drain hole extension extending generally vertically and downward from and around the drain hole, a tower portion for supporting one or more beverage dispensing valves thereon generally along a front vertical surface thereof and positioned along a top end thereof, and the tower portion secured to a lower housing portion, the lower housing portion having a drain tray receiving portion in which the drain tray can be placed and generally retained so that the drain tray is positioned generally below the beverage dispensing valves, a rigid drain tube secured to the lower housing portion, the drain tube having a first end sized to slidingly receive the drain hole extension therein and positioned to so receive the drain hole extension when the drain tray is retained in the drain tray receiving portion so that the drain tray can be removed from the drain tray receiving portion and the drain hole extension removed from the drain tube first end by generally vertical upward lifting of the drain tray and so that the drain tray can be placed into the drain tray receiving portion and the drain hole extension inserted into the drain tube first end by generally vertical downward movement of the drain tray.

4. The dispenser as defined in claim 3, and the drain tray having a perimeter edge defining a groove, and the drain tray receiving portion having a generally vertically extending support wall for cooperative insertion into the drain tray perimeter edge groove when the drain tray is held in the drain tray receiving portion for providing securing therebetween.

5. A beverage dispenser, comprising:

a drain tray having a bottom surface inclined towards a drain hole in the drain tray and having a drain hole extension extending generally vertically and downward from and around the drain hole, a tower portion for supporting one or more beverage dispensing valves thereon generally along a front vertical surface thereof and positioned along a top end thereof, and the tower portion secured to a lower housing portion along a top rear perimeter edge thereof, the lower housing portion having a drain tray receiving portion in which the drain tray can be placed and generally retained so that the drain tray is positioned generally below the beverage dispensing valves, a rigid drain tube secured to and extending substantially vertically along a rear surface of the lower housing portion, the drain tube having a first end positioned at the lower housing portion top rear perimeter edge below the tower portion, and the drain tube first end sized to slidingly receive the drain hole extension therein and positioned to so receive the drain hole extension when the drain tray is retained in the drain tray receiving portion so that the drain tray can be removed from the drain tray receiving portion and the drain hole extension removed from the drain tube first end by generally vertical upward lifting of the drain tray and so that the drain tray can be placed into the drain tray receiving portion and the drain hole extension inserted into the drain tube first end by generally vertical downward movement of the drain tray and the tower and lower housing portions defining a clearance area for facilitating the vertical upward and downward movement of the drain tray beneath the tower portion.

6. The dispenser as defined in claim 5, and the drain tray having a perimeter edge defining a groove, and the drain tray receiving portion having a generally vertically extending support wall for cooperative insertion into the drain tray perimeter edge groove when the drain tray is held in the drain tray receiving portion for providing securing therebetween.

7. A beverage dispenser, comprising:

a drain tray having a bottom surface inclined towards a drain hole in the drain tray and having a drain hole extension extending generally vertically and downward from and around the drain hole, a housing portion having a generally vertically extending front surface, the front surface having a top end for receiving one or more beverage dispensing valves thereon and a bottom end, a drain tray receiving portion extending from the housing portion transverse to the housing portion front surface and at the bottom surface thereof, the drain tray receiving portion for retaining the drain tray wherein therein the drain tray is positioned generally below the beverage dispensing valves, a rigid drain tube secured to the housing portion, the drain tube having a first end sized to slidingly receive the drain hole extension therein and positioned to so receive the drain hole extension when the drain tray is retained in the drain tray receiving portion so that the drain tray can be removed from the drain tray receiving portion and the drain hole extension removed from the drain tube first end by generally vertical upward lifting of the drain tray and so that the drain tray can be placed into the drain tray receiving portion and the drain hole extension inserted into the drain tube first end by generally vertical downward movement of the drain tray, and the drain tube being L-shaped having a relatively short vertical portion at the first end and a relatively longer second portion extending generally horizontally along a housing bottom end.

8. The dispenser as defined in claim 7, and the drain tray having a perimeter edge defining a groove, and the drain tray receiving portion having a generally vertically extending support wall for cooperative insertion into the drain tray perimeter edge groove when the drain tray is held in the drain tray receiving portion for providing securing therebetween.

9. A beverage dispenser, comprising:

a drain tray having a bottom surface inclined towards a drain hole in the drain tray and having a drain hole extension extending generally vertically and downward from and around the drain hole, a housing portion having a generally vertically extending front surface, the front surface having a top end for receiving one or more beverage dispensing valves thereon and a bottom end, the bottom end having a clearance area there along, a drain tray receiving portion extending from the clearance area transverse to the housing portion front surface, the drain tray receiving portion for retaining the drain tray wherein the drain tray is positioned generally below the beverage dispensing valves and where a portion of a front end of the drain tray resides in the clearance area, a rigid drain tube secured to the housing portion, the drain tube having a first end positioned in the clearance area and sized to slidingly receive the drain hole extension therein and positioned to so receive the drain hole extension when the drain tray is retained in the drain tray receiving portion so that the drain tray can be removed from the drain tray receiving portion and the drain hole extension removed from the drain tube first end by generally vertical upward lifting of the drain tray and so that the drain tray can be placed into the drain tray receiving portion and the drain hole extension inserted into the drain tube first end by generally vertical downward movement of the drain tray and the clearance area for facilitating the vertical upward and downward movement of the drain tray, and the drain tube being L-shaped having a relatively short vertical portion at the first end and a relatively longer second portion extending generally horizontally along a housing bottom end.

10. The dispenser as defined in claim 9, and the drain tray having a perimeter edge defining a groove, and the drain tray receiving portion having a generally vertically extending support wall for cooperative insertion into the drain tray perimeter edge groove when the drain tray is held in the drain tray receiving portion for providing securing therebetween.

* * * * *